US006662971B1

(12) United States Patent
Nguyen et al.

(10) Patent No.: US 6,662,971 B1
(45) Date of Patent: Dec. 16, 2003

(54) AUTOMATIC PRESSING MECHANISM

(76) Inventors: Ryan R. Nguyen, 4172 Glenwood St., Irvine, CA (US) 92604; Kim-Dinh Doan, 4172 Glenwood St., Irvine, CA (US) 92604

( * ) Notice: Subject to any disclaimer, the term of this patent is extended or adjusted under 35 U.S.C. 154(b) by 0 days.

(21) Appl. No.: 10/121,798

(22) Filed: Apr. 10, 2002

(51) Int. Cl.[7] ..... B65D 35/28
(52) U.S. Cl. ..... 222/101; 222/105; 222/106
(58) Field of Search ..... 222/101, 105, 222/106, 333, 99, 100

(56) References Cited

U.S. PATENT DOCUMENTS 2,921,717 A * 1/1960 Borak ..... 222/101
2,936,006 A * 5/1960 Henley ..... 222/101
3,232,488 A * 2/1966 Headberg ..... 222/101
4,125,206 A * 11/1978 Wilson ..... 222/101
4,223,809 A * 9/1980 Martin ..... 222/96
4,403,714 A * 9/1983 Kane ..... 222/101
5,511,696 A 4/1996 Gustafson
RE35,587 E 8/1997 Okamura et al.
5,873,495 A 2/1999 Saint-Germain
5,897,030 A 4/1999 Stangle

* cited by examiner

*Primary Examiner*—Pedro Philogene
*Assistant Examiner*—Stephanie L. Willatt
(74) *Attorney, Agent, or Firm*—Blakely, Sokoloff, Taylor and Zaffman

(57) ABSTRACT

In one embodiment of the invention, a press assembly includes a gear assembly, a threaded rod, and a roller assembly. The gear assembly causes a rotational movement when activated. The threaded rod is coupled to the gear assembly and rotates in direction of the rotational movement caused by the gear assembly. The roller assembly is coupled to the threaded rod and moves linearly between a first end and a second end along guide slots when the threaded rod rotates.

30 Claims, 6 Drawing Sheets

AUTOMATIC PRESSING MECHANISM

BACKGROUND

1. Field of the Invention

This invention relates to pressing mechanisms. In particular, the invention relates to automatic pressing mechanisms.

2. Description of Related Art

There are many applications that require a pressing mechanism to press or squeeze a deformable or collapsible object or material. Examples of these applications include food preparation, food stuffing, squeeze tube dispensers, paper pressing. Typically these applications are performed manually where the user presses a roll against the object or material, or simply use hand to squeeze the material out of the container. This manual method is laborious, inaccurate, and time-consuming.

In addition, many popular products for home and business uses are contained in squeeze tubes. Examples of the products include toothpaste, lotion, cream, soap, shampoo, hair conditioner, medicated creams, and bath gels. These tubes are usually dispensed by manually squeezing the tube. To remove the contents out as completely as possible, it is recommended that the tube is squeezed from one end toward the tube opening end. However, doing so requires the tube users to exercise some force and pressure on the tube. For young children, old, weak or sick people, this may be a problem. Even healthy adults sometimes find it inconvenient to do so.

Therefore, there is a need to have a technique for a pressing mechanism that can overcome the above drawbacks.

BRIEF DESCRIPTION OF THE DRAWINGS

The features and advantages of the present invention will become apparent from the following detailed description of the present invention in which.

DESCRIPTION OF THE INVENTION

In one embodiment of the invention, a press assembly includes a gear assembly, a threaded rod, and a roller assembly. The gear assembly causes a rotational movement when activated. The threaded rod is coupled to the gear assembly and rotates in direction of the rotational movement caused by the gear assembly. The roller assembly is coupled to the threaded rod and moves linearly between a first end and a second end along guide slots when the threaded rod rotates.

In the following description, for purposes of explanation, numerous details are set forth in order to provide a thorough understanding of the present invention. However, it will be apparent to one skilled in the art that these specific details are not required in order to practice the present invention. In other instances, well-known structures are shown in block diagram form in order not to obscure the present invention.

Figure 1:
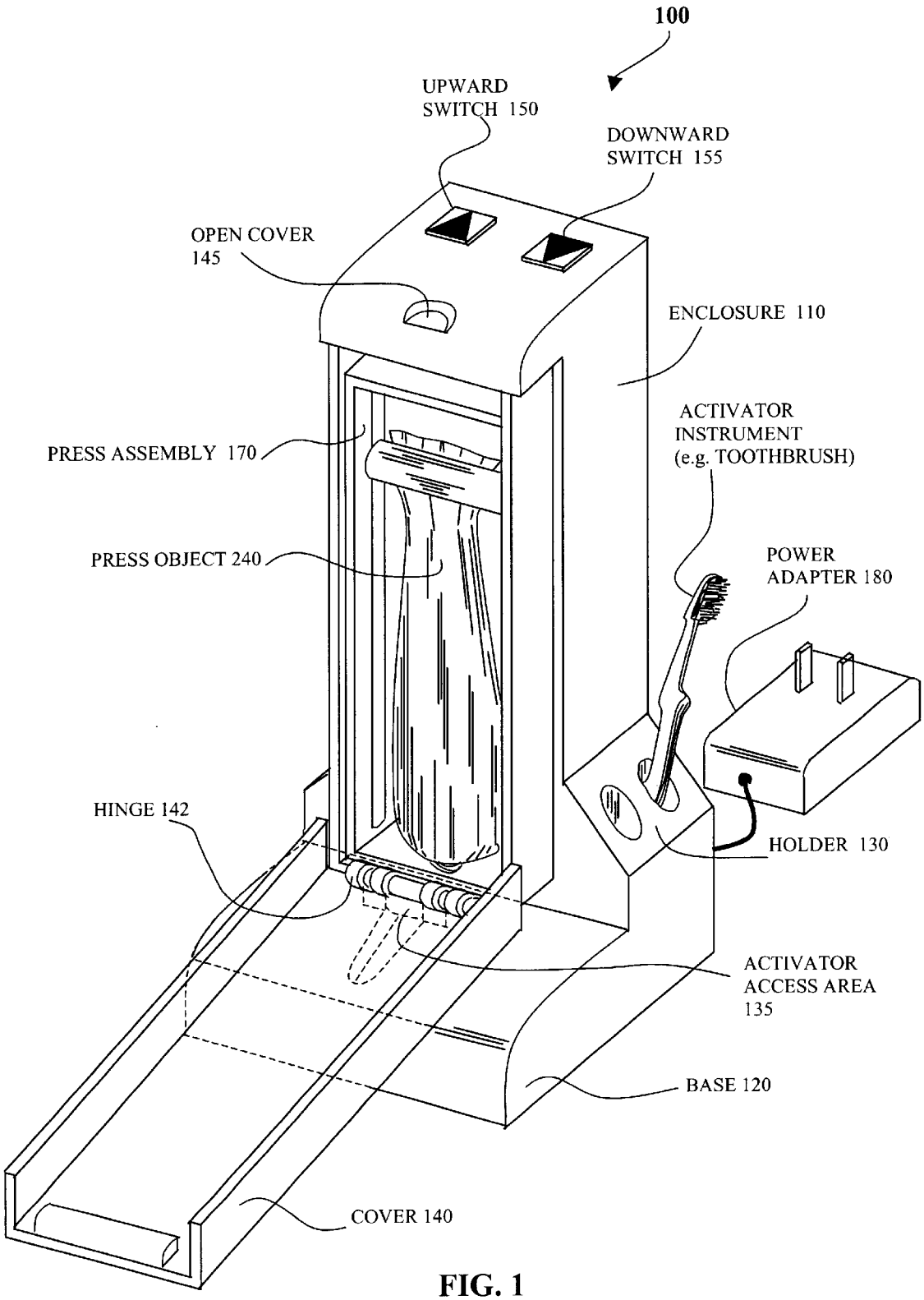
FIG. 1 is a diagram illustrating a press unit in which one embodiment of the invention can be practiced.

FIG. 1 is a diagram illustrating a press unit 100 in which one embodiment of the invention can be practiced. The press unit 100 includes an enclosure 110, a press assembly 170, and an optional power adapter 180. Note that the press unit 100 may be mechanical or electrical. A mechanical pressing unit does not need the power adapter 180.

The enclosure 110 houses the press assembly 170 and provides access for the user to activate various actions on the press assembly 170. Typically, the enclosure 110 is made of durable material including plastic, metal, or any other suitable material. The design of the enclosure 110 corresponds to the environment where the unit 100 is used. The press unit 100 may be positioned vertically or horizontally depending on how the press assembly 170 is used. For example, when the unit 100 is used as a toothpaste dispenser, it may be positioned vertically. When the unit 100 is used as a food preparation unit, it may be positioned horizontally. In the following description, references will be made with respect to vertical placement of the press unit. It is contemplated that when the unit 100 is place horizontally, the terms "upward", "up", "downward", and "down" may be replaced by appropriate descriptors (e.g., "left", "right"). The enclosure 110 includes a base 120, a holder 130, an activator access area 135, a cover 140, an open cover button 145, an upward switch 150, and a downward switch 155. For a mechanical press unit, the upward and downward switches 150 and 155 may not be needed.

The base 120 provides support for the press unit 100 when it is placed vertically and stands on a flat surface. The holder 130 provides placement of activators for roll presser or accessories. For example, when used as a toothpaste dispenser, the holder 130 may contain toothbrushes, dental accessories such as floss dispenser, etc. The activator access area 135 defines an access area to allow an activator instrument (e.g., a toothbrush, a cup, a finger) to activate the press assembly 170. This access area 135 may include an opening with proper guides to help aligning the activator instrument. The cover 140 provides cover for the press assembly 170. In normal use, the cover 140 is in closed position. The cover 140 may be opened to allow the user to replace the element being pressed, such as the toothpaste. The open cover button 145, when pressed, activates the cover 140 in the open position. The cover 140 may be partially or fully opened around a hinge 142. The cover 140 may be made by a transparent material such as clear plastic so that the user can see the internal of the press unit. This may allow the user to decide if a press material or object 240 (e.g., toothpaste tube) needs to be replaced. The upward and downward buttons 150 and 155 allow the user to control the moving elements in the press assembly 170 to move upward or downward, respectively. For example, when the toothpaste tube needs to be replaced, the roll member in the press assembly 170 may be at the bottom location. The user presses the upward button 150 so that this roll member is moved upward. Then, the user presses the cover button 145 to open the cover 140, removes the used toothpaste tube and replaces with a new one.

The press assembly 170 provides an automatic pressing mechanism to press or squeeze a press object or material. The press assembly 170 may be operated mechanically or electrically. The press assembly 170 may be integrated with the enclosure 110 or removable. The press assembly 170 is described in FIG. 2.

The power adapter 180 provides electrical power to the press assembly 170 when it is electrically implemented. For electrical press assembly 170, the power adapter 180 may also be optional because batteries may be used to provide power. The power adapter 180 may be implemented as a wall-mounted adapter.

Figure 2:
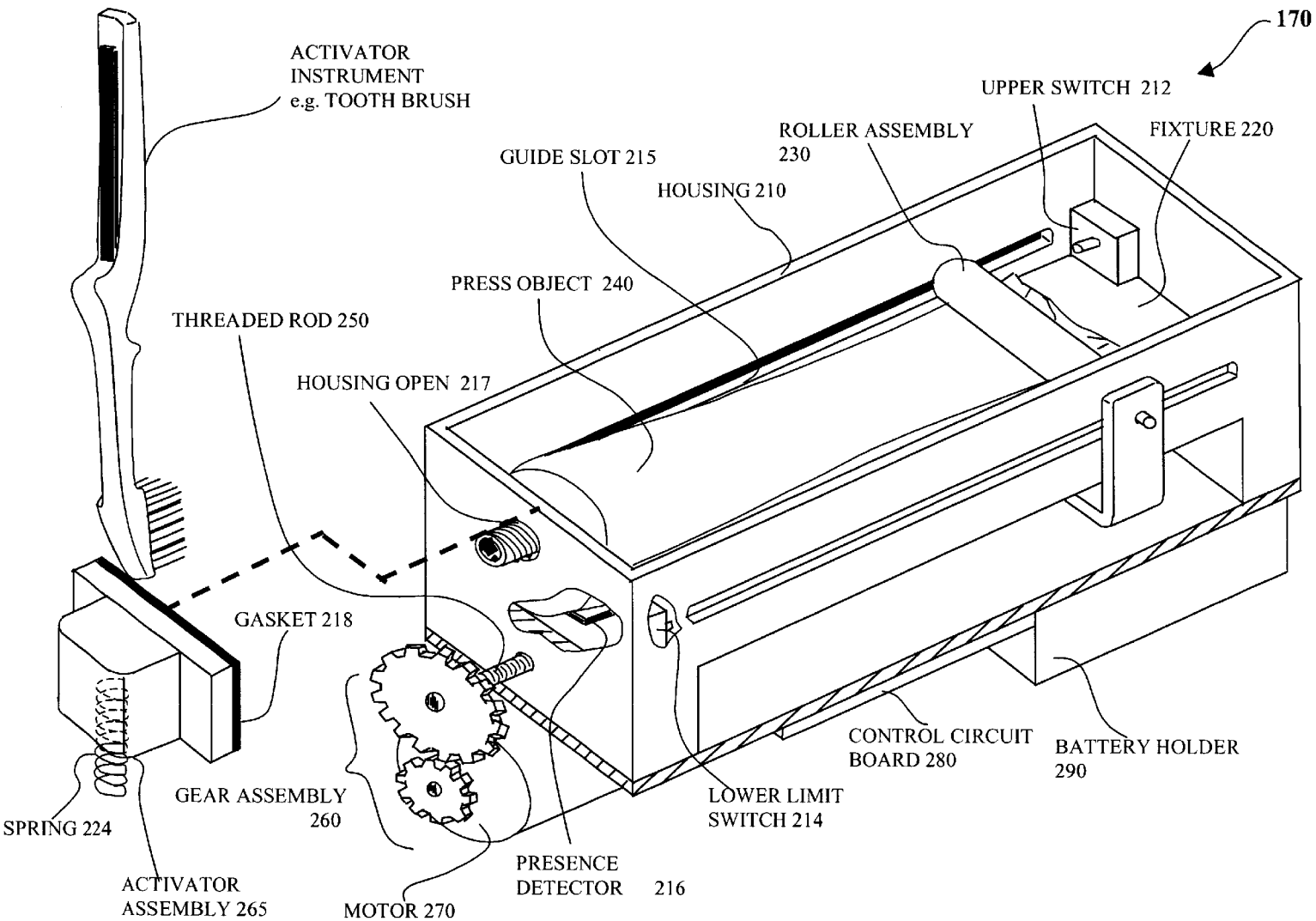
FIG. 2 is a diagram illustrating an electrical press assembly according to one embodiment of the invention.

FIG. 2 is a diagram illustrating an electrical press assembly 170 according to one embodiment of the invention. The electrical press assembly 170 includes a housing 210, a fixture 220, a roller assembly 230, a threaded rod 250, a gear assembly 260, an activator assembly 265, a motor 270, a control circuit board 280, and a battery holder 290. It is contemplated that the electrical press assembly 170 may contain more or less components than the above depending on the usage.

The housing 210 holds the press object 240. The press object 240 may be a squeeze tube like the toothpaste, lotion, bath gel, or any other materials that need to be pressed or squeezed, such as food materials, chemical compounds, building materials, industrial materials. The dimensions of the housing 210 depend on the press object 240. The housing 210 may be made by any suitable material such as plastic or metal, or any combination. The housing 210 has guide slots 215 on two sides to guide the roller assembly 230 as it moves along from one end to another. The guide slots 215 may be straight or curved depending on the shape of the press object 240 and the desirable pressing actions. The housing 210 may have a housing opening 217 to accommodate the release of the content of the press object 240 if necessary (e.g., squeezing the toothpaste out of the toothpaste tube).

The fixture 220 may be part of the housing 210 or may be separated and connected to the housing 210 by some fastening mechanism such as screwing or glue. The fixture 220 is positioned between the roller assembly 230 and the threaded rod 250 to provide a surface against which the press object 240 is pressed when the roller assembly 230 moves along the guide slots 215. The fixture 220 is typically approximately parallel to the threaded rod 250. The fixture 220 may be formed to have a curved or slanted portion to accommodate the shape of the pressing element 240 such as at the opening end of a squeeze tube.

The fixture 220 may contain upper and lower switches 212 and 214 and a presence detector 216. The upper limit switch 212 is used to detect when the roller assembly 230 moves to the upper end. The upper limit switch 212, when activated, may de-energize the motor 270. For example, when the user pushes the upward switch 150, the roller assembly 230 moves upward until it reaches and activates the upper limit switch 212. This switch 212, once activated, de-energizes the motor 270 to stop the movement of the roller assembly 230. The lower limit switch 214 is used to indicate when the roller assembly 230 moves to the lower end. It may be activated directly by the roller assembly 230. The presence detector 216 detects if the press object 240 has been placed on the fixture 220. When the press object 240 is placed on the fixture 220, it activates the presence detector 216. The presence detector 216 may be a switch, a circuit connection assembly, a sensor, etc. Note that not all of the switches or detectors are used. These switches and detectors provide signals to the circuit board 280 and can be activated by a number of methods. For example, the roller assembly 230 may be automatically moved upward to the upper limit switch 212 as soon as it touches the lower limit switch 214 or when the cover 140 is opened.

The roller assembly 230 is coupled to the threaded rod 250 so that it moves linearly between the two ends of the housing 210 along the guide slots 215 when the threaded rod 250 rotates. One of the main features of the present invention is the conversion of the rotational movement of the threaded rod 250 into a linear movement of the roller assembly 230. As the roller assembly 230 moves along the guide slots 215 in parallel with the fixture 220, it creates a pressing action on the press object 240 or flattens the object 240. If the press object 240 is a squeeze tube, this pressing action effectively squeezes the content of the squeeze tube out of the tube opening. Therefore, the press object 240 or material can be pressed automatically.

The threaded rod 250 is coupled to the gear assembly 260 and rotates in the direction of the rotational movement caused by the gear assembly 260. The threaded rod 250 may be made by any suitable material, preferably by metal to provide sufficient mechanical strength. The pitch, size, and the number of the threads on the threaded rod 250 depend on the application and usage. A fine pitch threaded rod provides smooth and slow linear motion. The threaded rod 250 is inserted through the housing 210 through two holes on two ends so that it can be placed firmly beneath the fixture 220 in horizontal position when the press unit 100 is placed horizontally.

Figure 3:
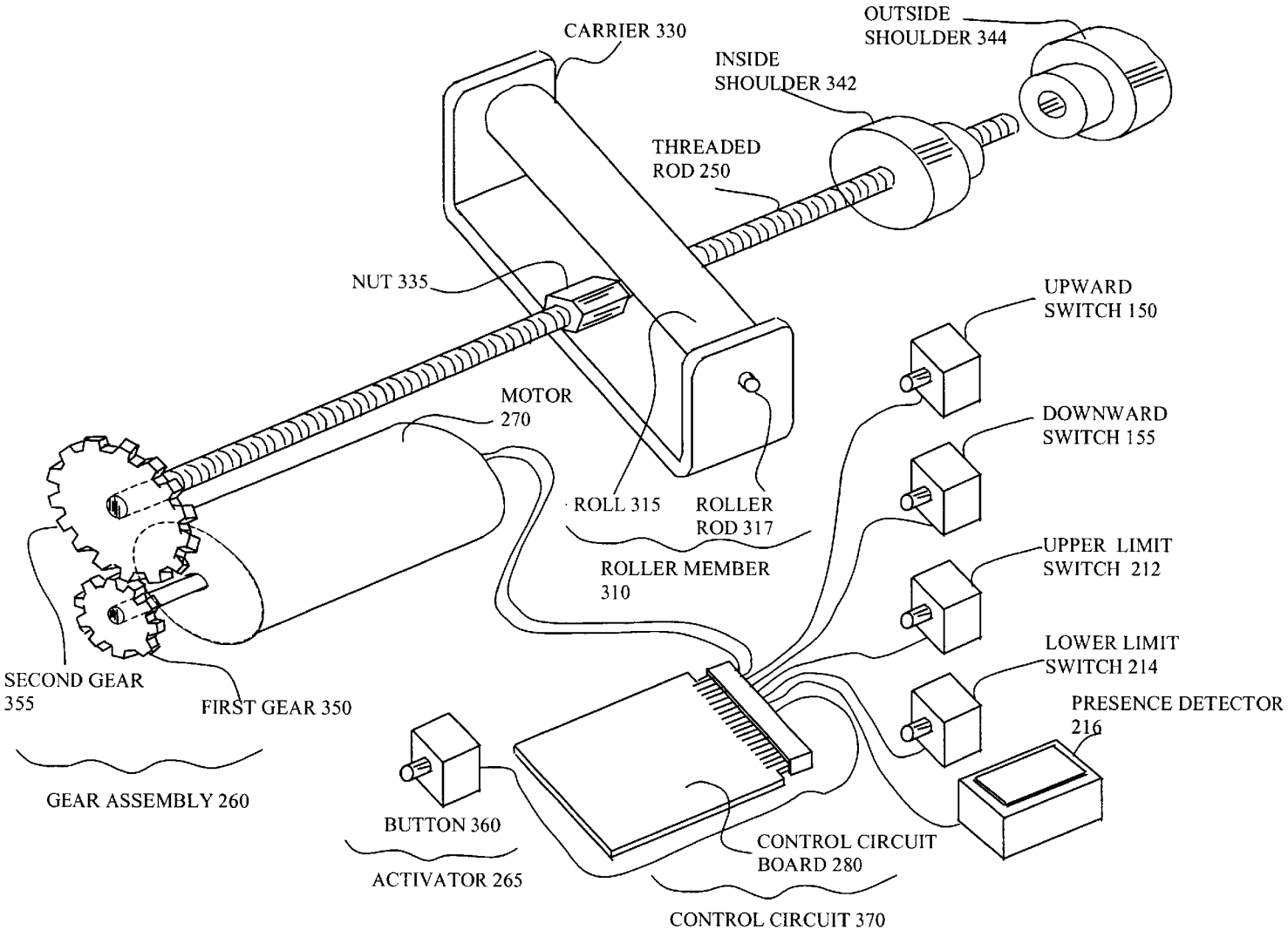
FIG. 3 is a diagram illustrating an electrical pressing mechanism according to one embodiment of the invention.
Figure 4:
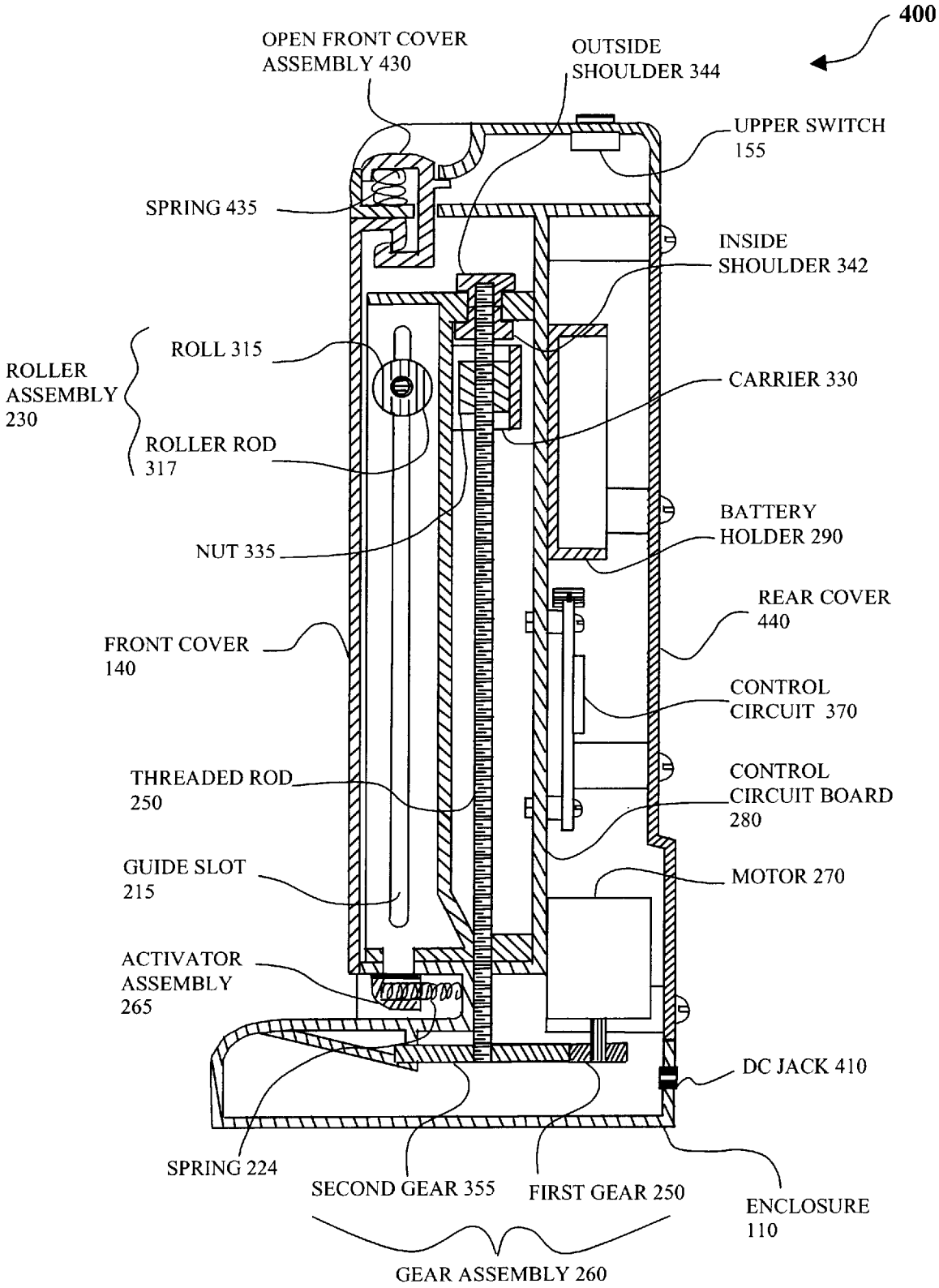
FIG. 4 is a diagram illustrating a cross-sectional side view of an electrical press assembly according to one embodiment of the invention.
Figure 5:
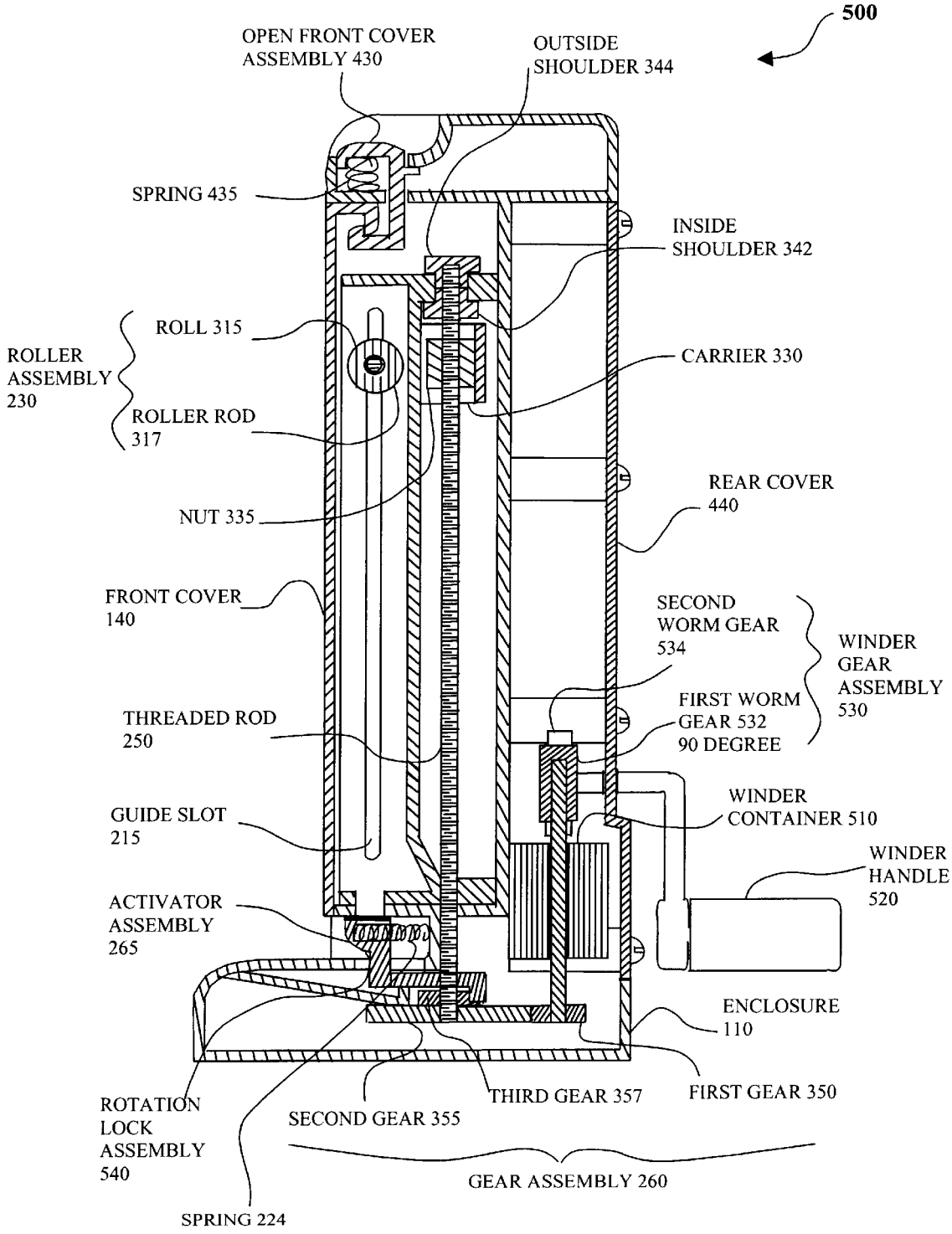
FIG. 5 is a diagram illustrating a cross-sectional side view of a mechanical press assembly according to one embodiment of the invention.

The gear assembly 260 causes a rotational movement when activated. When operated electrically, the gear assembly is connected to the motor 270 as shown in FIGS. 2 to 4. When operated mechanically, the gear assembly 260 is connected to a winder assembly as shown in FIG. 5. The gear assembly 260 is connected to the threaded rod 250 to cause a rotational movement of the threaded rod 250 as the gear assembly is activated.

The activator assembly 265 may include an instrument to activate the movement of the roller assembly 230. In addition, it may also house a seal or a gasket 218 in order to close the opening of the press object 240 when in normal state. This is useful to avoid leakage of the contents, especially when the press object 240 is positioned upright and contain leakable materials such as toothpaste. When the activator assembly 265 is activated, it opens the gasket 218 so that the content inside the press object 240 may be squeezed out. A spring 224 may be used to exert a return action on the instrument.

The motor 270 generates rotational force when energized. The motor 270 is a direct current (DC) motor which may provide a forward rotation and a reverse rotation according to the polarities of the applied voltage. The control circuit board 280 contains a control circuit to provide control actions to the motor 270. The control circuit is connected to the activator 265, the upward and downward switches 150 and 155 (FIG. 1), the upper and lower switches 212 and 214, the presence detector 216, and the motor 270 to energize the motor when the activator 265, or the upward and downward switches 150 and 155, is activated. The control circuit provides first and second control actions corresponding to first and second rotational directions, one is clockwise and the other is counterclockwise. In essence, the control circuit switches the polarities of the voltage applied to the motor 270 to energize the motor 270 to generate the desired rotational direction. The battery holder 290 holds a battery or batteries to provide power to the motor 270. The battery or batteries may not be needed when the press assembly 170 operates directly from the line power.

FIG. 3 is a diagram illustrating an electrical pressing mechanism according to one embodiment of the invention.

The roller assembly 230 shown in FIG. 2 includes a roller member 310 and a carrier 330. The roller member 310 is positioned in an approximately parallel direction to the fixture 220 (FIG. 2) with a distance sufficiently short so that the roller member 310 applies sufficient pressure on the press object 240 (FIG. 2) when moving linearly along the guide slots 215. The roller member 310 includes a roll 315 and a roller rod 317. The roll 315 is cylindrically shaped with a hollow channel. The roll 315 may be made by any suitable material, preferably metal to provide sufficient mechanical strength when pressed against the press object 240. The roller rod 317 is inserted though the cylindrical-shaped roll via the hollow channel. The roller rod 317 may also be integrated to the roll 315. The roller rod 317 provides attachment to the carrier 330.

The carrier 330 is an approximately U-shaped member attached to two ends of the roller member 310 via the roller rod 317. In one embodiment, the carrier 330 has two holes through which the roller rod 317 is inserted. The carrier 330 is also attached to the threaded rod 250 (FIG. 2) by a nut 335. The nut 335 is permanently glued to the carrier 330 by a strong adhesive. Typically the nut 335 is a hex nut and is fitted to the threaded rod 250 so that the carrier 330 moves linearly when the threaded rod 250 rotates. The carrier 330 and the nut 335 may be made of any suitable material, preferably metal and compatible with the roll member 310.

The threaded rod 250 is attached to the carrier 330 through the nut 335. As the threaded rod 250 rotates, the nut 335 advances in a linear fashion and moves the carrier 330 and the roll member 310. The threaded rod 250 is confined within a movement area by two shoulders at the distal end. As described in FIG. 2, the threaded rod 250 is inserted through the housing 210 via two holes, one hole near the gear assembly 260 and one hole at the distal end of the threaded rod 250. An inside shoulder 342 and an outside shoulder 244 are glued to the threaded rod 250 at the distal end. The inside and outside shoulders 342 and 344 are located inside and outside, respectively, the housing 210 to secure the rotational movement of the threaded rod 250. Typically, the inside and outside shoulders 342 and 344 are made of a durable material such as nylon.

The gear assembly 260 includes first and second gears 350 and 355. The first gear 350 is connected to the motor 270 and has a number of teeth. The first gear 350 rotates in a direction according to the motor 270. The first gear 350 rotates in a first rotational direction when the motor 170 is energized by the control circuit in the first control action to cause the roller assembly move linearly from the first end to the second end. The first gear 350 rotates in the second rotational direction when the motor 170 is energized by the control circuit in the second control action to cause the roller assembly move linearly in the reverse direction from the second end to the first end. The second gear 355 has a number of teeth configured to fit the first plurality of teeth of the first gear. The second gear 355 rotates in the second and first rotational directions when the first gear 350 rotates in the first and second, respectively, rotational directions. In other words, the second gear 355 rotates in the opposite or reverse direction with respect to the first gear 350. Typically, the first and second gears 350 and 355 are spur gears. The number of teeth for the first gear 350 is typically less than that of the second gear 355. In one embodiment, the ratio between the numbers of teeth of the two gears ranges from 2 to 10.

The activator assembly 265 shown in FIG. 2 may include a button 360 with connection to a control circuit 370 on the control circuit board 280 (FIG. 2). The button 360 may be a momentary switch so that when it is pressed, it forms a connection to the control circuit 370 and the motor 270 is energized causing the gear assembly 260 to rotate. The power may be applied with a predetermined duration so that the motor is energized for a short period. In this short period, the gear assembly 260 causes a short rotation rotating the threaded rod 250, which causes the carrier 330 to advance in a short linear distance. The roller member 310 therefore moves linearly in the short linear distance forcing a pressure on the press object 240 (FIG. 2). In this way, when the press object 240 is a squeeze tube such as a toothpaste tube, a predetermined amount of toothpaste is squeezed out of the tube. Alternatively, the button 360 may be a single pole single throw type of switch where connection to the control circuit is made as long as it is held closed during which time the motor 270 is energized and the roller member 310 is moved. When the button is released, the motor 270 is de-energized and the roller member 310 stops moving. In this way, the user has a direct control on how far the roller member 310 is moved. When the press unit 100 is used as a toothpaste dispenser, the user inserts the toothbrush into the activator access area 135 to push the button 360 which causes an amount of toothpaste to be squeezed out of the tube opening dropping onto the brush of the toothbrush. Other uses or applications may have similar action. For example, when the press unit 100 is used as a lotion, soap dispenser, the user may use a finger to push the button 360.

The control circuit 370 is also connected to the upward and downward switches 150 and 155 shown in FIG. 1. These switches are typically single pole single throw switches. When the upward switch 150 is pressed, power is applied continuously to the motor 270 and the threaded rod 250 turns in one direction moving the roller member 310 upward (when the unit is positioned vertically) until the upward switch 150 is released. Similarly, when the downward switch 155 is pressed, power is applied continuously to the motor 270 in the reverse direction and the threaded rod 250 turns in the other direction moving the roller member 310 downward until the downward switch 155 is released.

FIG. 4 is a diagram illustrating a sectional side view 400 of an electrical presser according to one embodiment of the invention. The sectional side view 400 shows a side view of the pressing unit 100 in an upright position.

The enclosure 110 includes the front cover 140 and a rear cover 440. The rear cover 440 may be open for access to the battery holder 280, the control circuit board 280, or the motor 270. The enclosure 110 also includes a DC jack 410 for plugging the power adapter when the unit is operated by power. The arrangement of the elements in the unit 100 may be any suitable arrangement according to the application. For example, the battery holder 280 may be located between the control circuit board 280 and the motor 270.

FIG. 5 is a diagram illustrating a sectional side view of a mechanical press assembly 500 according to one embodiment of the invention. The mechanical press assembly 500 operates in a similar manner as the electrical press unit except that no electrical power is used. The mechanical press assembly 500 does not have the motor 270, the control circuit board 280, the battery holder 290, and the power adapter 180. The mechanical press assembly 500 includes the same basic elements as in the electrical press assembly such as the threaded rod 250, the roller assembly 230, the gear assembly 260 (except that the gear assembly 260 may include a third gear 357 as described later). In addition to these basic elements, the mechanical press assembly 500 includes a winder container 510, a winder handle 520, a winder gear assembly 530, and a rotation lock assembly 540.

In the following description, the unit 100 is assumed to be in an upright position.

The winder container 510 contains winding coil or any winding mechanism that can be wound. The winder handle 520 is used to wind the winder container 510. Before the unit is used, the user turns the winder handle 520 as many turns as necessary to wind the winding coil inside the winder container 510. The winder gear assembly 530 converts the rotation of the winder handle 520 into appropriate rotation for the winder container 510. The winder gear assembly 530 includes a first worm gear 532 and a second worm gear 534 positioned in an approximately perpendicular direction to each other.

When the winder handle 520 is turned, the gear assembly 260 is rotated to move the roller member 310 upward. The user stops turning the winder handle 520 when the desired location of the roller member 310 is reached.

The rotation lock assembly 540 locks the gear assembly 260 when in the normal state and unlocks the gear assembly when the activator 360 is activated.

Figure 6:
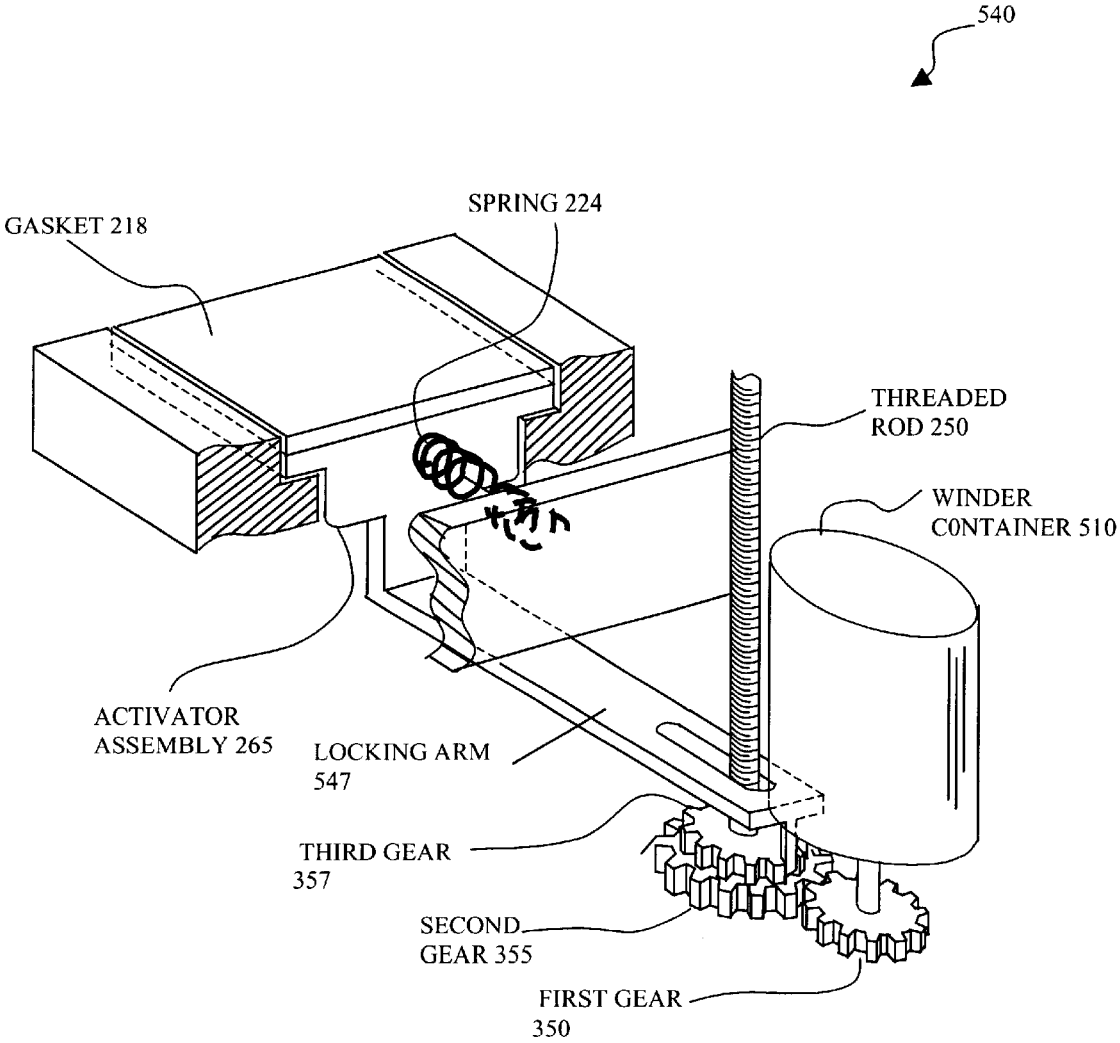
FIG. 6 is a diagram illustrating a rotation lock assembly of a mechanical press assembly according to one embodiment of the invention.

FIG. 6 is a diagram illustrating the rotation lock assembly 540 of a mechanical press assembly according to one embodiment of the invention.

The rotation lock assembly 540 includes a spring 224 and a locking arm 547. The spring 224 is fitted to the button 360. The locking arm 547 has an L shape and is fitted to the first gear 350. The locking arm 547 has two positions: an unlock position and a lock position. The locking arm 547 is coupled to the activator 360 and is in the unlock position when the activator 360 is activated. It is in the lock position when the activator 360 is de-activated. In the embodiment shown in FIG. 6, the locking arm 547 has a movement slot to travel from the lock position to the unlock position. The threaded rod 250 is inserted through this movement slot. Other mechanisms may also be possible. The locking arm 547 causes a locking action in the lock position when it snaps into a ridge of a third gear 357 connected on top of the second gear 355. When locked, the gear assembly 260 does not rotate and the roller member 310 is kept stationary. When the button 360 is pushed, the locking arm 547 is moved to the unlock position slightly away from the gear tooth allowing the first gear 350 to rotate which causes the roller member 310 to moves downward. Thereafter, the spring 224 is sprung back and the locking arm 547 returns to the locking position, snapping into the next ridge of the third gear 357, stopping the rotation and the roller member 310 is stopped. The winder container 510 is selected to provide appropriate rewinding or recoiling force so that when the locking arm 547 is in the unlock position, the first gear 350 rotates with an appropriate angular speed.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. An apparatus comprising:

a gear assembly to cause a rotational movement when activated;

a threaded rod coupled to the gear assembly the threaded rod rotating in direction of the rotational movement caused by the gear assembly;

a roller assembly coupled to the threaded rod, the roller assembly moving linearly between a first end and a second end along guide slots of a housing when the threaded rod rotates;

an activator coupled to the gear assembly to activate the gear assembly to cause the rotational movement;

a winder assembly coupled to the gear assembly to control the rotational movement; and a rotation lock assembly coupled to the activator to cause a locking action to the first gear, wherein the gear assembly comprising: a first gear having a first plurality of teeth coupled to the winder assembly, the first gear rotating in the first rotational direction when the winder assembly is activated to cause the roller assembly move linearly from the first end to the second end, the first gear rotating in the second rotational direction when the activator is activated to cause the roller assembly move linearly from the second end to the first end, and a second gear having a second plurality of teeth configured to fit the first plurality of teeth of the first gear, the second gear rotating in the second and first rotational directions when the first gear rotates in the first and second, respectively, rotational directions.

2. The apparatus of claim 1 further comprising:

a fixture positioned between the roller assembly and the threaded rod to provide a surface against which a press object is pressed when the roller assembly moves along the guide slots, the fixture being approximately parallel to the threaded rod.

3. The apparatus of claim 2 wherein the fixture is formed to have a curved portion to accommodate an opening end of the press object.

4. The apparatus of claim 2 wherein the roller assembly comprises:

a roller member positioned in an approximately parallel direction to the fixture with a distance sufficiently short so that the roller member applies sufficient pressure on the squeeze tube when moving linearly along the guide slots; and a carrier attached to the roller member and the threaded rod, the carrier having a nut fitted to the threaded rod so that the carrier moves linearly when the threaded rod rotates.

5. The apparatus of claim 4 wherein the roller member comprises:

a cylindrical-shaped roll having a hollow channel; and a roller rod inserted though the cylindrical-shaped roll via the hollow channel, the roller rod being attached to the carrier.

6. The apparatus of claim 4 wherein the carrier is an approximately U-shaped member attached to two ends of the roller member.

7. The apparatus of claim 1 further comprising:

a shoulder element attached to a distal end of the threaded rod to secure the rotational movement of the threaded rod.

8. The apparatus of claim 1 further comprising:

a motor coupled to the gear assembly and the activator to control the rotational movement; and a control circuit coupled to the motor to energize the motor, the control circuit providing first and second control actions corresponding to first and second rotational directions.

9. The apparatus of claim 1 wherein the activator comprises:

a button located near the tube opening, the button, when pushed, causing the control circuit to energize the motor to provide one of the first and second control actions.

10. The apparatus of claim 9 further comprising:

a switch coupled to the control circuit to cause the control circuit to energize the motor to provide an other one of the first and second control actions.

11. The apparatus of claim 1 wherein the rotation lock assembly comprises:

a spring coupled to the activator; and a locking arm coupled to the activator, the locking arm being in an unlock position when the activator is activated and in a lock position when the activator is de-activated.

12. The apparatus of claim 11 wherein when the locking arm is in the unlock position, the first gear is free to rotate causing the roller member to move linearly.

13. The apparatus of claim 11 wherein when the locking arm is in the lock position, the first gear is stopped rotating causing the roller member to stop.

14. The apparatus of claim 1 wherein the winder assembly comprises:

a winder container to contain a winding mechanism;

a winder handle to wind the winding mechanism; and a winder gear assembly coupled to the winder handle and the winder.

15. The apparatus of claim 14 wherein the winder gear assembly comprises:

a spur gear; and a worm gear coupled to the spur gear perpendicularly.

16. A press unit comprising:

an enclosure;

a housing located inside the enclosure to hold a press object, the housing having guide slots; and a press assembly coupled to the housing, the press assembly comprising:

a gear assembly to cause a rotational movement when activated, a threaded rod coupled to the gear assembly, the threaded rod rotating in direction of the rotational movement caused by the gear assembly, the threaded rod being inserted through the housing, a roller assembly coupled to the threaded rod, the roller assembly moving linearly between a first end and a second end along the guide slots of the housing when the threaded rod rotates, an activator coupled to the gear assembly to activate the gear assembly to cause the rotational movement, a winder assembly coupled to the gear assembly to control the rotational movement, a rotation lock assembly coupled to the activator to cause a locking action to the first gear, wherein the gear assembly comprises:

a first gear having a first plurality of teeth coupled to the winder assembly, the first gear rotating in the first rotational direction when the winder assembly is activated to cause the roller assembly move linearly from the first end to the second end, the first gear rotating in the second rotational direction when the activator is activated to cause the roller assembly move linearly from the second end to the first end, and a second gear having a second plurality of teeth configured to fit the first plurality of teeth of the first gear, the second gear rotating in the second and first rotational directions when the first gear rotates in the first and second, respectively, rotational directions.

17. The press unit of claim 16 in the press assembly further comprises:

a fixture positioned between the roller assembly and the threaded rod to provide a surface against which the press object is pressed when the roller assembly moves along the guide slots, the fixture being approximately parallel to the threaded rod.

18. The press unit of claim 17 wherein the fixture is formed to have a curved portion to accommodate an opening end of the press object.

19. The press unit of claim 17 wherein the roller assembly comprises:

a roller member positioned in an approximately parallel direction to the fixture with a distance sufficiently short so that the roller member applies sufficient pressure on the squeeze tube when moving linearly along the guide slots; and a carrier attached to the roller member and the threaded rod, the carrier having a nut fitted to the threaded rod so that the carrier moves linearly when the threaded rod rotates.

20. The press unit of claim 19 wherein the roller member comprises:

a cylindrical-shaped roll having a hollow channel; and a roller rod inserted though the cylindrical-shaped roll via the hollow channel, the roller rod being attached to the carrier.

21. The press unit of claim 19 wherein the carrier is an approximately U-shaped member attached to two ends of the roller member.

22. The press unit of claim 16 wherein the press assembly further comprises:

a shoulder element attached to a distal end of the threaded rod to secure the rotational movement of the threaded rod.

23. The press unit of claim 16 wherein the press assembly further comprises:

a motor coupled to the gear assembly and the activator to control the rotational movement; and a control circuit coupled to the motor to energize the motor, the control circuit providing first and second control actions corresponding to first and second rotational directions.

24. The press unit of claim 16 wherein the activator comprises:

a button located near the tube opening, the button, when pushed, causing the control circuit to energize the motor to provide one of the first and second control actions.

25. The press unit of claim 24 wherein the press assembly further comprises:

a switch coupled to the control circuit to cause the control circuit to energize the motor to provide an other one of the first and second control actions.

26. The press unit of claim 16 wherein the rotation lock assembly comprises:

a spring coupled to the activator; and a locking arm coupled to the activator, the locking arm being in an unlock position when the activator is activated and in a lock position when the activator is de-activated.

27. The press unit of claim 26 wherein when the locking arm is in the unlock position, the first gear is free to rotate causing the roller member to move linearly.

28. The press unit of claim 26 wherein when the locking arm is in the lock position, the first gear is stopped rotating causing the roller member to stop.

29. The press unit of claim 16 wherein the winder assembly comprises:

a winder container to contain a winding mechanism;

a winder handle to wind the winding mechanism; and a winder gear assembly coupled to the winder handle and the winder.

30. The press unit of claim 29 wherein the winder gear assembly comprises:

a spur gear; and a worn gear coupled to the spur gear perpendicularly.

* * * * *